US005975672A

United States Patent [19]

Wen

[11] Patent Number: 5,975,672

[45] Date of Patent: Nov. 2, 1999

[54] INK JET PRINTING APPARATUS AND METHOD ACCOMMODATING PRINTING MODE CONTROL

[75] Inventor: Xin Wen, Rochester, N.Y.

[73] Assignee: Eastman Kodak Company, Rochester, N.Y.

[21] Appl. No.: 08/899,616

[22] Filed: Jul. 24, 1997

[51] Int. Cl.[6] ..... B41J 2/205

[52] U.S. Cl. ..... 347/15; 347/11

[58] Field of Search ..... 347/15, 9, 10, 347/11

[56] References Cited

U.S. PATENT DOCUMENTS

| | | | |
|---|---|---|---|
| 4,748,453 | 5/1988 | Lin et al. . | |
| 5,012,257 | 4/1991 | Lowe et al. . | |
| 5,321,427 | 6/1994 | Agar et al. | 347/10 X |
| 5,557,304 | 9/1996 | Stortz | 347/15 |
| 5,602,572 | 2/1997 | Rylander . | |
| 5,617,123 | 4/1997 | Takaoka et al. | 347/15 |
| 5,621,524 | 4/1997 | Mitani . | |
| 5,631,675 | 5/1997 | Futagawa | 347/10 |
| 5,633,662 | 5/1997 | Allen et al. . | |

*Primary Examiner*—Richard Moses
*Attorney, Agent, or Firm*—Walter S. Stevens

[57] ABSTRACT

Ink jet printing apparatus accommodating printing mode control for printing an output image on a receiver medium in response to an input image file having a plurality of pixel values. The printing mode is selected in such a manner that image artifacts are eliminated without excessively increasing printing time or ink laydown. The apparatus comprises a printhead and at least one nozzle integrally connected to the printhead, which nozzle is capable of ejecting an ink droplet therefrom. The apparatus also comprises a waveform generator associated with the nozzle for generating an electronic waveform to be supplied to the nozzle, so that the nozzle ejects the ink droplet in response to the waveform supplied thereto. In addition, a printer mode look-up table is also provided for storing a printing mode assigned to the waveform. A calibrator is connected to the first calibrator and is also associated with the waveform generator for adjusting the electronic waveform. An image halftoning unit is connected to the second calibrator for halftoning the calibrated image file in order to generate a halftoned image file having the pixel value defined by the waveform serial number. All the pixels are obtained without increasing the number of printing passes.

38 Claims, 6 Drawing Sheets

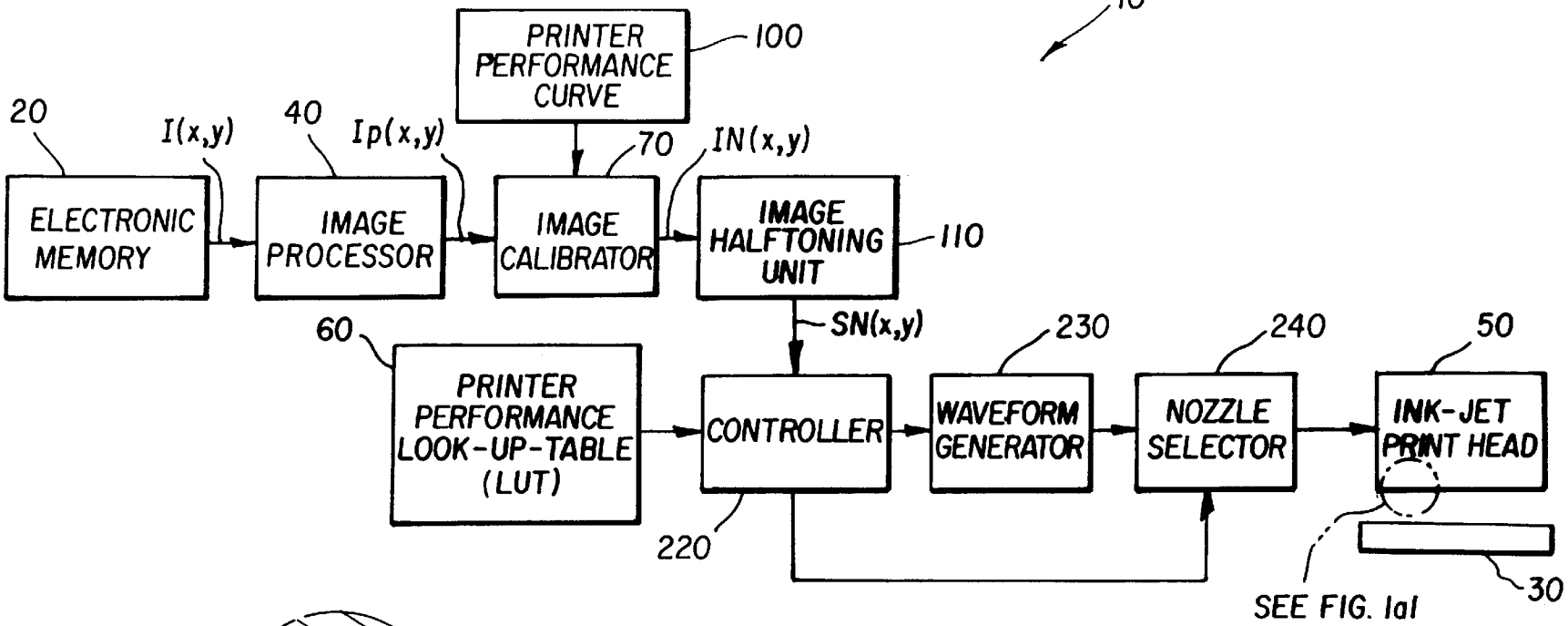
FIG. 1a
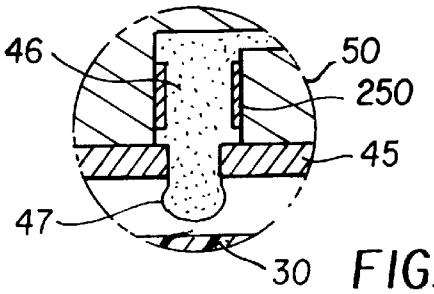
FIG. 1a1

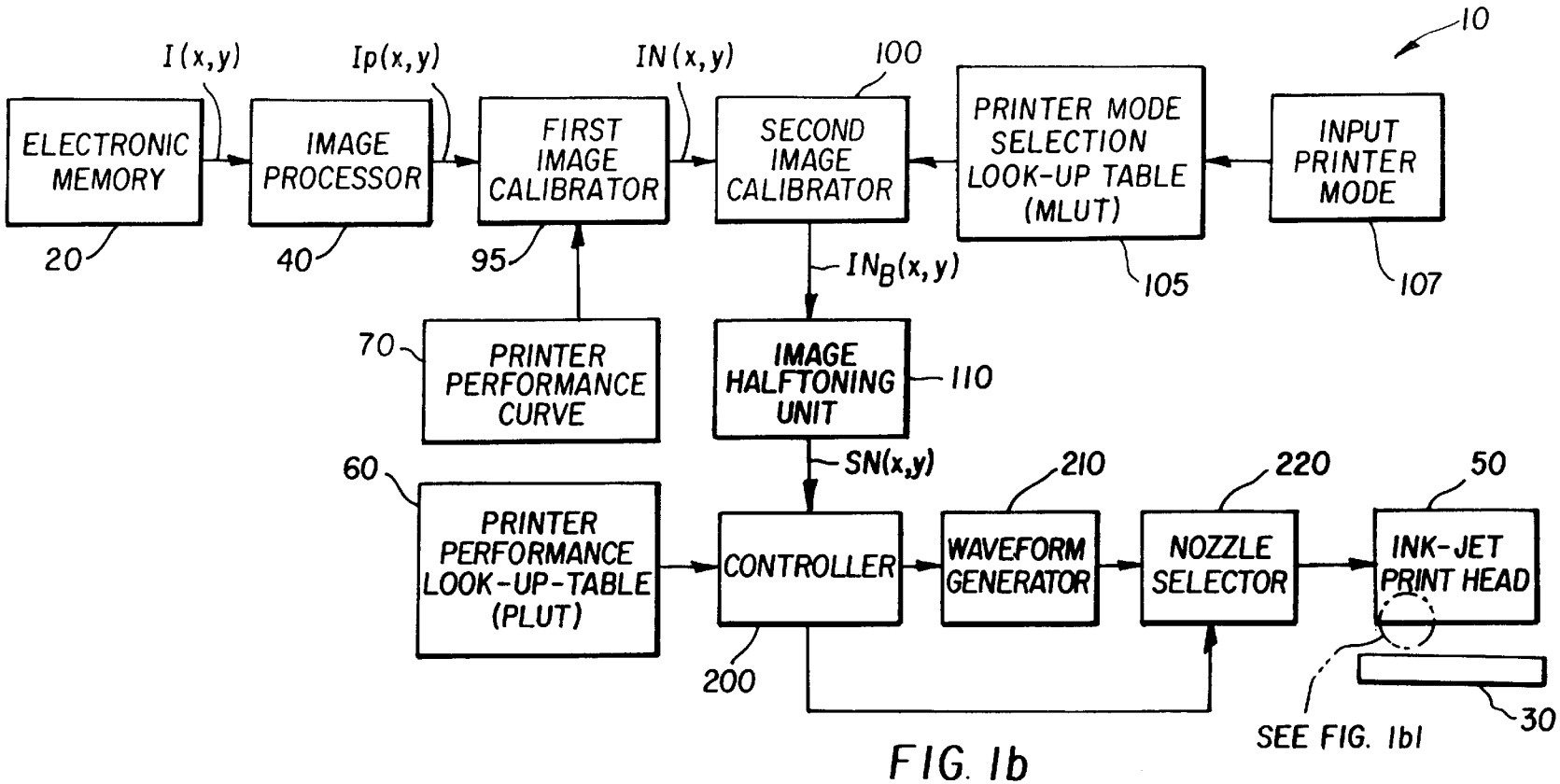
FIG. 1b
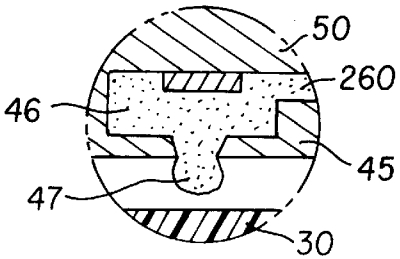
FIG. 1b1

60

| WAVEFROM SERIAL NUMBER (SNi) | PRINT DENSITY (Di) | 1st PULSE | | | 2st PULSE | | |
|---|---|---|---|---|---|---|---|
| | | $A_1$ | $W_1$ | $S_{1-2}$ | $A_2$ | $W_2$ | $S_{2-3}$ |
| $SN_1$ | D1 | 1 | 1 | N/A | | | |
| $SN_2$ | D2 | 1 | 1 | 1 | 1 | 0.8 | N/A |
| $SN_3$ | D3 | | | | | | |
| $SN_4$ | D4 | ... | ... | ... | ... | ... | ... |
| ... | ... | | | | | | |
| $SN_N$ | Dmax | | | | | | |

FIG. 2

105

| PRINTING MODE | | | MAXIMUM IN |
|---|---|---|---|
| RECEIVER TYPE | RESOLUTION (DPI) | SPEED | |
| 1 | 600 | A | $SN_A$ |
| 1 | 600 | B | $SN_B$ |
| 1 | 600 | C | $SN_C$ |
| 1 | 600 | D | $SN_D$ |
| ⋮ | ⋮ | ⋮ | ⋮ |

FIG. 7

INK JET PRINTING APPARATUS AND METHOD ACCOMMODATING PRINTING MODE CONTROL

CROSS REFERENCE TO RELATED APPLICATIONS

This invention is related to commonly owned U.S. patent application Ser. No. 08/899,574 titled "Digital Ink Jet Printing Apparatus and Method" filed Jul. 24, 1997, in the name of Xin Wen, et al.

FIELD OF THE INVENTION

The present invention generally relates to digital image printing apparatus and methods, and more particularly to an ink jet printing apparatus and method accommodating printing mode control.

BACKGROUND OF THE INVENTION

An ink jet printer produces images on a receiver medium by ejecting ink droplets onto the receiver medium in an imagewise fashion. The advantages of non-impact, low-noise, low-energy use, low cost and the capability to print on plain paper are largely responsible for the wide acceptance of ink jet printers in the marketplace.

The quality of images printed by ink jet printers is related to the absorption of inks into an ink receiver which can be plain paper, coated paper, transparent film and the like. Ink absorption capability of the ink receiver is characterized by properties of the receiver, such as the amount and the rate of the ink absorption. These properties are determined by the type of receiver. For example, it may be desirable to select specialty receivers coated with ink absorption layers which can absorb more ink at a faster rate (i.e., shorter "drying" time) than plain paper.

However, a problem associated with ink jet printing is excessive laydown of inks on the ink receiver. That is, when inks are placed on the receiver at an amount or rate higher than the receiver can accept, image defects can occur. For example, image artifacts can occur when neighboring ink pixels come in contact with each other and coalesce. This type of image artifact is commonly referred as "ink beading". Coalescence of ink pixels on the receiver causes inks to diffuse or flow among ink pixels and results in a non-uniform or mottled appearance of the printed image. This ink diffusion problem is most visible at the boundaries of printed areas comprising different colors, where the ink of one color diffuses into the adjacent area of a different color ink to form a finger-shaped pattern. This latter image defect is commonly referred to as "color bleeding".

Prior art techniques attempt to overcome ink beading and color bleeding by reducing the number of ink pixels printed in each printing pass. In this regard, U.S. Pat. No. 4,748,453 discloses a technique involving printing an image area with at least two passes. In each pass, the ink pixels are printed in a checkerboard pattern of diagonally adjacent pixels. The final image is formed by the sum of the complimentary checkerboard patterns in different printing passes. A disadvantage of this technique is the increased printing time caused by multiple printing passes.

U.S. Pat. Nos. 5,012,257 and 5,602,572 disclose techniques which define a spatial cell (or superpixel) of multiple pixels. A subset of the pixels within the cell are not printed (or "turned off") to reduce the coalescence of neighboring ink spots. These techniques have the disadvantage of reduced spatial resolution in the printed images.

U.S. Pat. No. 5,633,662 disclosed computation techniques that converts the pixel values in the source image file, that requires higher amount of ink laydown on the ink receiver, to a new image file that corresponds to reduced ink laydown. This method address the above described problem for ink jet printing that prints a two density levels (single-bit) for each color.

Therefore, there has been a long-felt need to provide an ink jet printing apparatus and method accommodating printing mode control for printing multiple-density levels on a receiver medium in a manner solving the problems of ink beading and color bleeding while avoiding excessive printing time and excessive ink laydown.

SUMMARY OF THE INVENTION

The present invention resides in an ink jet printing apparatus and method accommodating printing mode control for printing an image on a receiver medium in response to an input image file of multiple density levels. The printing is selected in such a manner that image artifacts are eliminated without excessively increasing printing time or ink laydown. The apparatus comprises a printhead and at least one nozzle integrally connected to the printhead, which nozzle is capable of ejecting an ink droplet therefrom. The apparatus also comprises a waveform generator associated with the nozzle for generating an electronic waveform to be supplied to the nozzle, so that the nozzle ejects the ink droplet in response to the waveform supplied thereto. In addition, a printer mode look-up table associated with the waveform generator is also provided for storing a printing mode assigned to the waveform. A calibrator is connected to the first calibrator and is also connected to the waveform generator for adjusting the electronic waveform so that excessive ink laydown is avoided. All the pixels are obtained without increasing the number of printing passes.

An object of the present invention is to provide an ink jet printer capable of producing digital images of continuous tone for gray-scaling while avoiding image artifacts, such as ink beading and color bleeding.

Another object of the present invention is to provide an ink depletion method for ink jet printers, the method being capable of printing multiple density levels while avoiding image defects.

Still another object of the present invention is to provide an ink depletion method responsive to a printing mode defined by a user of the ink jet printer.

A feature of the present invention is the provision of an ink depletion method that reduces ink laydown on an ink receiver by varying the volume of the ejected ink droplets.

Another feature of the present invention is the provision of look-up tables relating printed optical densities to electronic waveforms which drive a print head belonging to the printer, the electronic waveforms being associated with electronic waveform numbers.

Still another feature of the present invention is the provision of a first calibrator for calibrating an input image file to pixel values associated with the electronic waveform numbers.

Yet another feature of the present invention is the provision of a second calibrator that calibrates the calibrated image file of pixel values according to the printing mode input by the user in order to avoid excessive ink laydown.

An advantage of the present invention is that ink depletion is accomplished without increasing printing time.

Another advantage of the present invention is that ink depletion is achieved without reducing spatial resolution in the printed image.

These and other objects, features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

While the specification concludes with claims particularly pointing-out and distinctly claiming the subject matter of the present invention, it is believed the invention will be better understood from the following description when taken in conjunction with the accompanying drawings wherein:

FIG. 1*a* shows a system block diagram for an ink jet printer apparatus belonging to the present invention, the apparatus including a piezo-electric ink jet printhead, a printer performance Look-Up Table (PLUT) and a printer Mode Look-Up Table (PLUT);

FIG. 1*b* shows a system block diagram for an ink jet printer apparatus belonging to the present invention, the apparatus including a thermal ink jet printhead, a printer Performance Look-Up Table (PLUT) and a printer Mode Look-Up Table (MLUT);

FIG. 2 shows an enlargement of the PLUT of FIGS. 1*a* and 1*b*;

FIG. 7 is an enlargement of the MLUT of FIGS. 1*a* and 1*b*.

DETAILED DESCRIPTION OF THE INVENTION

Figure 3:
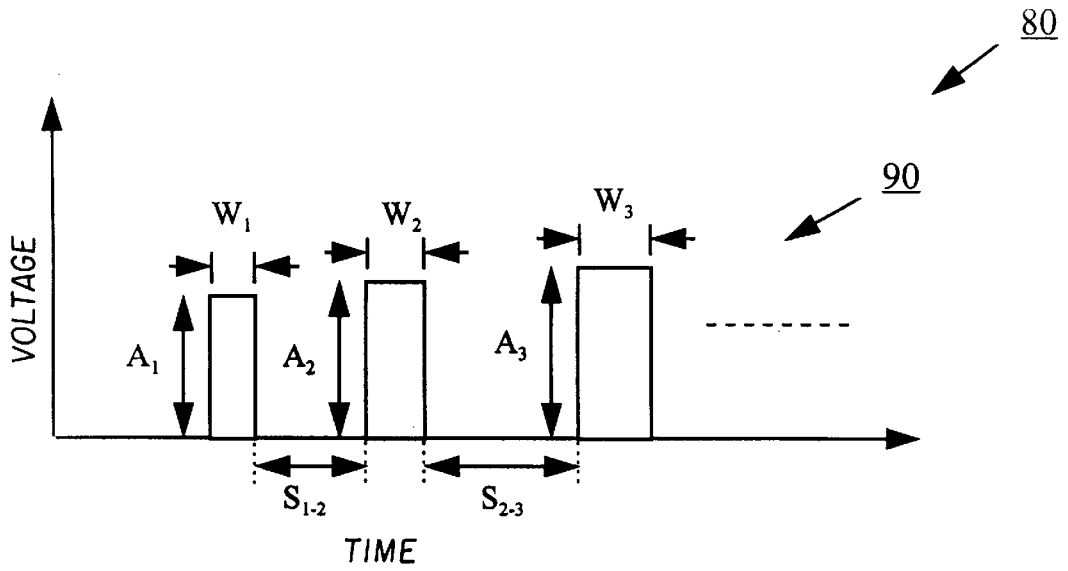
FIG. 3 is a graph illustrating an electronic waveform comprising a plurality or series of voltage pulses, the waveform being defined by predetermined parameters including the number of pulses, pulse amplitude, pulse width, and delay time between pulses.

Referring to FIGS. 1*a* and 1*b*, an ink jet printer apparatus, generally referred to as 10, includes an electronic memory 20 having a digital image file I(x,y) stored therein. With respect to image file I(x,y), the letters "x" and "y" designate column and row numbers, respectively, the combination of which define pixel locations in an image plane. More specifically, a plurality of color pixels with pixel values at each "x" and "y" location correspond to desired color densities (i.e., "aim densities") when printed on a receiver medium 30. Image file I(x,y) may be generated by a computer or, alternatively, provided as an input generated from a magnetic disk, compact disk, memory card, magnetic tape, digital camera, print scanner, film scanner, or the like. Moreover, image file I(x,y) may be provided in any suitable format well known in the art, such as page-description language or bitmap format.

Still referring to FIGS. 1*a* and 1*b*, electrically connected to electronic memory 20 is an image processor 40, which processes image file I(x,y). That is, image processor 40 is capable of performing any one of several desired operations on image file I(x,y). These operations may be, for example, decoding, decompression, rotation, resizing, coordinate transformation, mirror-image transformation, tone scale adjustment, color management, in addition to other desired operations. Image processor 40 generates an output image file $I_p(x,y)$, which includes a plurality of pixel values having color code values for ink pixels produced by a plurality of ink delivery nozzles 45 (only one of which is shown) integrally connected to an ink jet print head 50. Each nozzle 45 has an ink chamber 46 for ejecting an ink droplet 47 therefrom.

Referring to FIGS. 1*a*, 1*b*, 2, 3 and 4, data related to printer performance of printer apparatus 10 are stored in a printer Performance Look-Up Table (PLUT) 60 and a printer performance curve 70. PLUT 60 provides an electronic waveform, generally referred to as 80, comprising a group or series of "square" pulses, generally referred to as 90 (only three of which are shown), for driving print head 50. Electronic waveform 80 is characterized by waveform parameters, such as number of pulses, pulse widths (i.e., $W_1$, $W_2$, $W_3$ . . . ), voltage pulse amplitudes (i.e., $A_1$, $A_2$, $A_3$ . . . ), and delay time intervals (i.e., $S_{1-2}$, $S_{2-3}$ . . . ) between pulses 90. Predetermined values of pulse amplitudes, widths and delay time intervals between pulses are selected depending on a desired mode of operation of printhead 50, as disclosed more fully hereinbelow. For example, a desired mode of operation for a piezoelectric ink jet print head 50 may be that frequencies of pulses 90 are reinforced by the resonance frequencies of ink chamber 46, so that the energy cost for ink ejection is minimized. Predetermining the parametric values of the number of pulses, pulse amplitude, pulse width and time delay between pulses results in discrete ink droplet volumes that in turn are modulatable by electronic waveform 80. It is understood from the teachings herein that square pulses 90 are only an example of many possible electronic waveforms usable for driving print head 50. Alternative electronic waveforms usable with the present invention include, for example, triangular, trapezoidal, and sinusoidal waveforms, either in unipolar or bi-polar voltages. In addition, electronic waveform 80 may be fully or partially continuous without one or more delay time intervals ($S_{1-2}$, $S_{2-3}$ . . . ). Such waveforms have parameters analogous to the parameters of square wave 90. For example, a continuous sinusoidal waveform can be characterized by the period and the amplitude of each cycle or each half cycle plus a constant voltage.

Referring to FIGS. 2 and 3, PLUT 60 includes a plurality of optical density values $D_i$ (i=1, . . . , $D_{max}$) respectively corresponding to a plurality of electronic waveforms, with each waveform being described by a waveform serial number $SN_i$ (i=1, . . . , N). PLUT 60 also includes the previously mentioned parameters of number of pulses, pulse widths ($W_1$, $W_2$, $W_3$ . . . ), pulse amplitudes ($A_1$, $A_2$, $A_3$ . . . ), and delay time intervals between the pulses ($S_{1-2,\ S2-3}$ . . . ). In PLUT 60, optical densities $D_1$, $D_2$, $D_3$ . . . are tabulated as a monatomic function of $SN_i$ for a predetermined electronic waveform 80 (e.g., square wave 90). As used herein, the terminology "optical density" refers to reflective or transmittance optical density as measured by a densitometer (not shown) set in the well-known Status "A" or Status "M" mode, respectively. The reflective and transmittance optical densities are measured from reflective (e.g., coated paper) or transmittance (e.g., transparent film) ink receivers, respectively. The density $D_i$ is measured from a uniform density patch of a test image (not shown), which is printed by driving the nozzles with the electronic waveform corresponding to the waveform serial number $SN_i$. "N" is the total number of electronic waveforms in PLUT 60 and "$D_{max}$," is the maximum achievable optical density. However, it is understood from the teachings herein that a different set of parameters will obtain for electronic waveforms other than the square waveform 80 shown in FIG. 3.

Moreover, still referring to FIGS. 2 and 3, it may be appreciated that the series of electronic waveforms $SN_i$ listed in PLUT 60 are only a subset of all possible electronic waveforms capable of driving ink jet print head 50. However, when printing with all possible electronic waveforms, many electronic waveforms result in equal or similar optical densities $D_i$. Only suitable ones of these waveforms are selected and listed as the electronic waveforms in PLUT 60. Such a selection is made by minimizing a gap or difference between any two optical densities $D_i$ and the corresponding two consecutive waveform serial numbers $SN_i$. Minimizing such gaps minimize quantization errors and thereby arrive at suitable waveforms.

Figure 4:
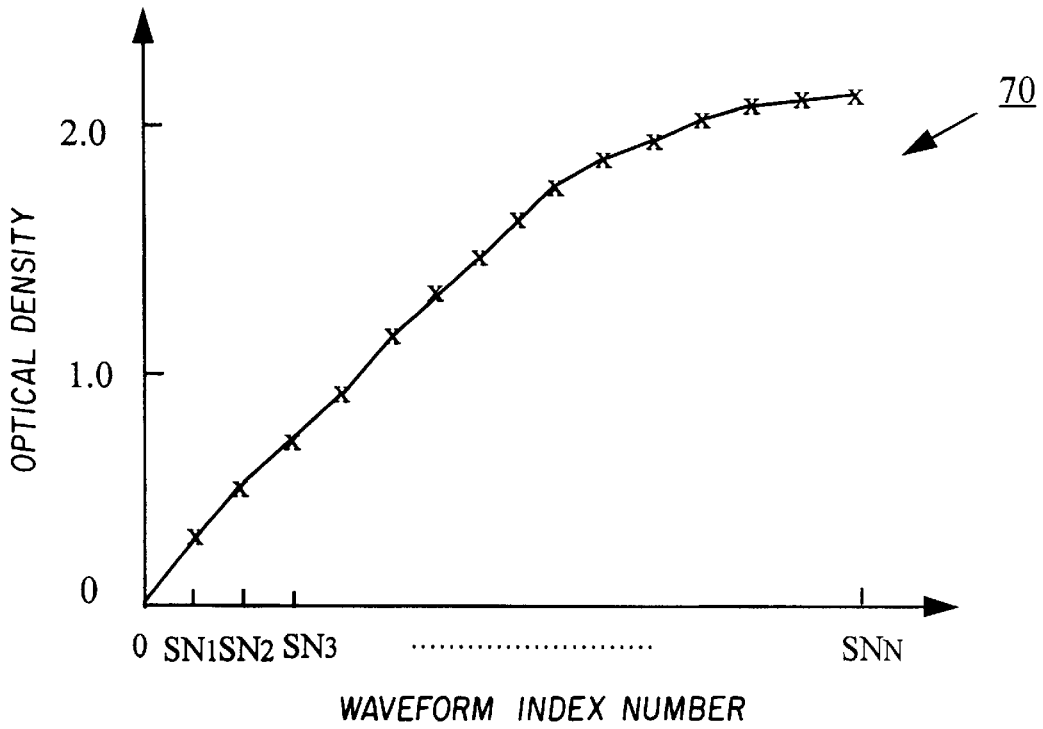
FIG. 4 is a graph showing optical density as a function of waveform index number.

Referring to FIG. 4, there is shown the printer performance curve 70 formed by plotting optical density as a function of waveform index number IN. To form printer performance curve 70, the N electronic waveforms in PLUT 60 are used first to print an image comprising uniform-density patches (not shown) from which optical densities are obtained for each waveform serial number $SN_i$ which corresponds to a unique waveform. The plurality of "x" symbols in FIG. 4 represent data points obtained from PLUT 60 corresponding to the SN's in PLUT 60. The data points "x" are interpolated by techniques well known in the art to produce a continuous curve for expressing IN as a continuous variable. The difference between waveform serial number $SN_i$ and waveform index number IN is as follows: waveform serial number $SN_i$ describes the discrete optical density levels (i.e., tones) which ink jet printer apparatus 10 is capable of producing. With respect to $SN_i$, the total level N ranges from 2 to 64 available levels, that is, 1 to 6 bit depth. The index number waveform IN represents substantially continuous tone. This is, there should be higher than 8 bit levels ($2^8$), for example, 10–12 bits, used to describe the waveform index numbers IN.

Returning to FIGS. 1*a* and 1*b*, image file $I_p(x,y)$ is calibrated by a first image calibrator 95. $I_p(x,y)$ includes color code pixel values for each of the yellow, magenta, cyan, and black color planes. Each color code pixel value is associated with a desired optical density for that color, as defined by the input image file I(x,y). The calibration performed by first image calibrator 95 converts each color pixel value to a waveform index number IN using (a) the aim density at that pixel for that color and (b) the printer performance curve 70. This calibration process results in an image file IN(x,y) with pixel values described by waveform index number IN.

Still referring to FIGS. 1*a* and 1*b*, the calibrated image file IN(x,y) is next calibrated in a second image calibrator 100 according to a printer mode selector 105 selected from a printer Mode Look-Up Table (MLUT) 107 that receives input from the printer user by means of an input printer mode selector 105. An example of MLUT 107 is shown in FIG. 7. The printing mode 107 includes parameters such as the receiver type (e.g., in the form of type "1", "2" . . . etc.) for receiver medium 30, printing resolution (e.g., in the form of 300, 600, 1200 dots per inch), and printing speed, or other desired printing mode parameters.

Second image calibrator 100 adjusts the electronic waveforms to avoid excessive ink laydown for the input printing mode. An example of how image calibrator 72 adjusts ink laydown as a function of printing speed is described hereinbelow. However, it is understood that the following description is by way of example only because various techniques within the scope of the present invention may be used to adjust ink laydown as a function of printing speed. In addition, calibration by second image calibrator 100 can readily be adapted to other printing modes in order to accommodate desired printing image resolution and ink receiver type.

Figure 5:
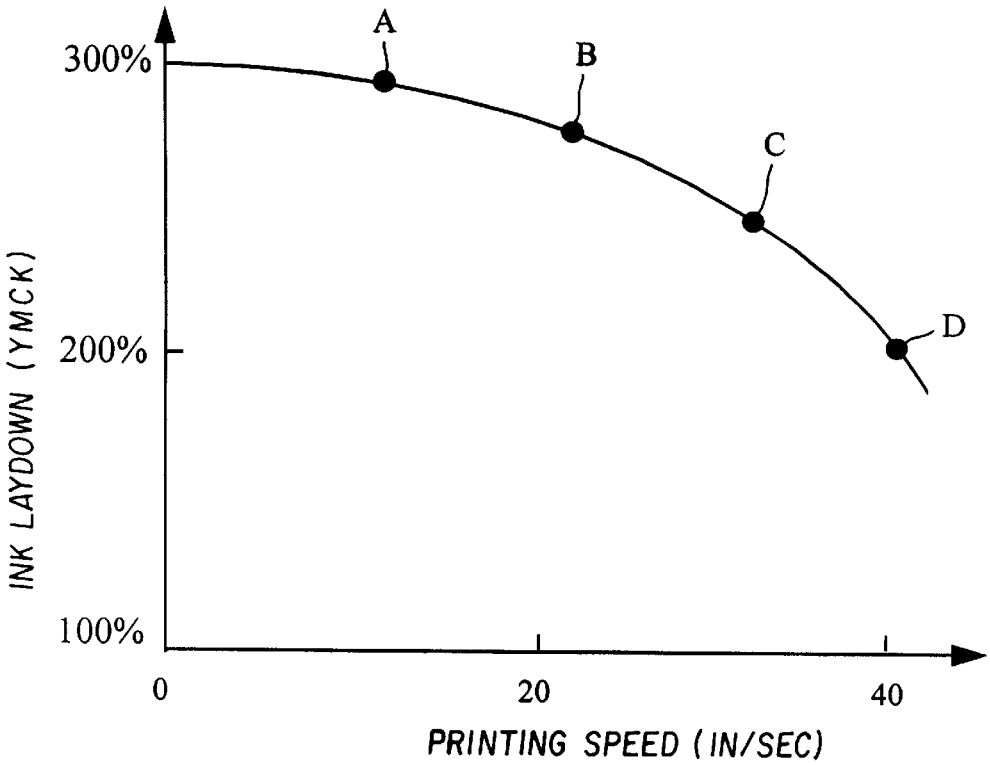
FIG. 5 is a graph showing percentage of maximum ink laydown on an ink receiver as a function of printing speed.

Therefore, referring to FIG. 5, there is shown an exemplary graph of maximum ink laydown on ink receiver 30 as a function of the printing speed. The maximum ink laydown is the maximum amount of ink laydown beyond which ink beading or coalescence appears on ink receiver 30. The printing speed is defined herein to mean the transport speed of the print head 50 relative to ink receiver 30. The printing mode in this example uses the four ink colors yellow, magenta, and cyan (designated by the letters Y, M, and C, respectively). An additional black color can be added. The printing resolution and receiver type in this example are fixed. The ink laydown $L_t$ is defined herein as the total amount of ink printed on a unit area of ink receiver 30 and is equal to the sum of the ink laydowns from yellow, magenta, cyan, and black colors, respectively, as follows:

$$L_t = L_y + L_m + L_c \tag{1}$$

where, $L_y$=ink laydown for yellow color;

$L_m$=ink laydown for magenta color; and $L_c$=ink laydown for cyan color.

Saturated ink laydown for each color on the receiver is defined as 100% of ink laydown at essentially zero printing speed. The ink laydowns at non-zero printing speeds are proportionally scaled to the saturated ink-laydown value and expressed in percentage values. The 300% ink laydown value represents the saturation of all four Y, M, and C inks on receiver 30.

Still referring to FIG. 5, maximum ink laydowns at different printing speeds are empirically obtained by varying ink laydown at a predetermined fixed printing speed. The previously mentioned test image (not shown) includes uniform density patches printed by the same electronic waveform. The ink laydown value at which ink beading appears represents the maximum ink laydown at that printing speed. With reference to FIG. 5, the maximum ink laydown decreases as the printing speed increases. For example, conditions from point "A" to point "D" represent increased printing speeds and decreased maximum ink laydowns. This phenomena of decreased ink laydown as printing speed increases arises from competition between the rate of ink absorption by the ink receiver 30 and the firing rate of ink droplets 47 from printhead nozzles 45. An increase in printing speed decreases the time interval between sequential ink droplets 47. This requires the amount of the printed ink to decrease in order to avoid coalescence between printed ink pixels.

Figure 6:
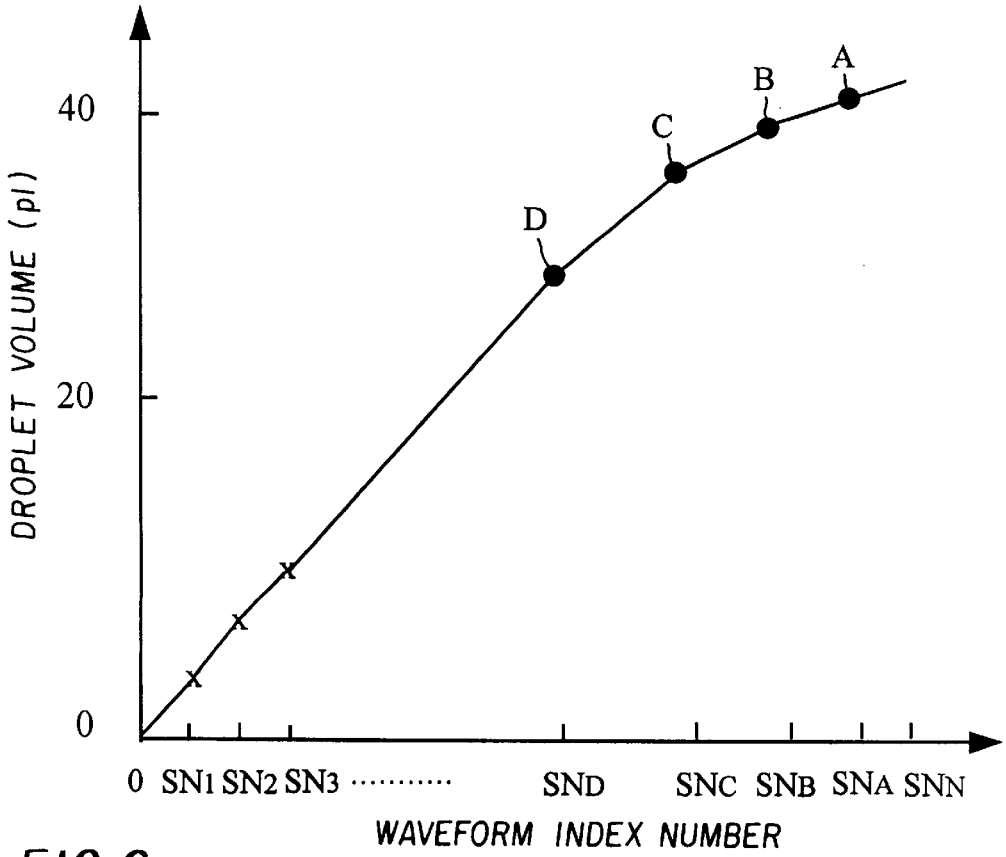
FIG. 6 is a graph showing ink droplet volume as a function of waveform index number.

FIG. 6 is a graph showing ink droplet volume as a function of waveform index number. Ink droplets 47 are ejected from the nozzles 45 when print head 50 is driven by electronic waveforms 80 corresponding to respective waveform serial numbers shown on the horizontal axis of FIG. 6. This ink droplet volume ejected from ink nozzles can be measured by a number of methods known in the art. For example, ink droplet volume can be measured by the light scattering technique disclosed in U.S. Pat. No. 5,621,524.

Referring to FIGS. 5 and 6, it may be understood that the functional dependence of the optical density and the ink droplet volumes in FIGS. 4 and 6 are consistent. That is, both FIGS. 5 and 6 show that increased ink droplet volumes lead to increased print optical densities. The printing conditions point "A" to point "D" in FIG. 5 have increased printing speeds, thus requiring decreased maximum ink laydowns. The decreased maximum ink laydowns from point "A" to point "D" are achieved by decreased ink droplet volumes as shown in FIG. 6. However, all the pixels are obtained without increasing the number of printing passes. Preferably, a single printing pass is used for maximum printing efficiency. The maximum ink laydown at printing conditions from point "A" to point "D" are printed by ink droplets 47 driven by electronic waveforms corresponding to waveform serial numbers $SN_A$, $SN_B$, $SN_C$, and $SN_D$. The waveform serial numbers $SN_A$, $SN_B$, $SN_C$ and $SN_D$ therefore represent the maximum waveform serial numbers available at each printing condition from point "A" to point "D".

Returning to FIGS. 1*a*, 1*b*, 2 and 7, MLUT 107 is obtained from the performance data shown in FIGS. 5 and 6. The purpose of the second image calibrator 100 is to convert calibrated image file IN(x,y) with pixel values in the range of $[0, SN_N]$ shown in PLUT 60 of FIG. 2, to image file $IN_B(x,y)$ with pixel values in the ranges as required by the input printing modes shown in FIG. 7. For example, for printing speeds from point "A" to point "D" for receiver type "I" and at 600 dpi printing resolution shown in FIG. 7, the pixel values in $IN_B(x,y)$ are required to be in the ranges of $[0, SN_A]$, $[0, SN_B]$, $[0, SN_C]$ and $[0, SN_D]$, etc. The new pixel values in $IN_B(X,y)$ in second image calibrator 100 linearly scale the pixel values (i.e. IN values) in IN(x,y) by a factor of $SN_A/SN_N$ for printing condition point "A" (or $SN_B/SN_N$, $SN_C/SN_N$, and $SN_D/SN_N$ for printing conditions from point "B" to point "D", respectively). It is understood that many other linear or non-linear formulations can be used in second image calibrator 100.

Referring to FIGS. 1*a* and 1*b*, image halftoning unit 110 is next used to minimize image artifacts. As used herein, the terminology "image halftoning" refers to the image processing technique which creates the appearance of intermediate tones by the spatial modulation of two tones, for example, black and white, or multiple levels of tones, such as black, white and gray levels. Halftoning improves image quality by minimizing image artifacts such as contouring and noise, both of which result from printing with a finite number of tone levels. In cases where multiple levels of tones are involved, image halftoning is often referred to as multiple level halftoning, or multi-level halftoning, or simply multi-toning. In the preferred embodiment of the invention, the term image halftoning includes bi-level and multiple level halftoning, as well.

Referring yet again to FIGS. 1*a* and 1*b*, the previously mentioned calibrated image file $IN_B(x,y)$ is input to image halftoning unit 110. Calibrated image file $IN_B(x,y)$ comprises a plurality of pixels with each pixel described by waveform index number IN for each color in a range as required by the selected printing mode and as calibrated in second image calibrator 100. As described hereinabove, the waveform index numbers IN are described in more than 8 bit per pixel per color. The total number of waveform serial numbers, N, corresponding to different optical densities is in the range $2^1$ to $2^6$, which is much smaller than the total number of waveform index numbers IN. However, simple quantization to the optical densities $D_i$, represented by the waveform serial numbers $SN_i$ produce visible image artifacts on the printed images. Therefore, the function of image halftoning unit 110 is to quantify the calibrated image file $IN_B(x,y)$ with pixel values described by the waveform index number IN to an image file SN(x,y) with pixel values described by the waveform serial numbers $SN_i$. This is accomplished by spatially modulating adjacent waveform serial numbers $SN_i$(i.e., image halftoning). These waveform serial numbers SN's are stored in printer performance PLUT 60. Details of the halftoning algorithms that can be used in image halftoning unit 110 are disclosed in U.S. patent application Ser. No. 08/899574 titled "Digital Ink Jet Printing Apparatus and Method".

Referring to FIGS. 1*a* and 1*b*, a halftoned image file SN(x,y) is next sent to a controller 200. Controller 200 performs the function of controlling the correct waveforms to be generated for corresponding pixels. Controller 200 accomplishes this function by (a) receiving a waveform serial number SN at each pixel and each color of the halftoned image file SN(x,y); (b) looking up the waveform parameters corresponding to the waveform serial number SN at that pixel and color of SN(x,y) using PLUT 60; (c) sending the waveform parameters to waveform generator 210; and (d) selecting the correct nozzle 45 corresponding to that color and the pixel by sending signals to a nozzle selector 220 that is connected to waveform generator 210. Waveform generator 210 generates the correct waveforms in response to the previously mentioned waveform parameters provided by controller 200. This provides the proper waveforms to actuate an electromechanical transducer 230 or a heat generating element 240 that in turn eject droplets 47 from the appropriate ink nozzles 45 in the print head 50. That is, ink jet print head 50 may be a piezo-electric ink jet printhead as shown in FIG. 1*a*. The electromechanical transducer 230 can comprise piezo-electric material, such as PZT. Alternatively, ink jet printhead 50 may be a thermal ink jet printhead comprising a heat generating element 240 disposed in at least one nozzle 45 for generating thermal energy in response to electronic waveforms for ejecting ink droplets 47 from nozzle 45, as shown in FIG. 1*b*. The waveform generator 210 can include an electronic circuit (not shown) for producing the correct digital waveforms in combination with a digital-to-analog converter (not shown), and amplifiers (also not shown). Image-wise activation and ink ejection of ink droplets 47 reproduces the input digital image on receiver 30. Since the electronic waveforms that drive ink delivery nozzles 45 are calibrated by second calibrator 72 for each printing condition, excessive ink laydown and related image defects are avoided.

An advantage of the present invention is that the ink laydown is reduced without increasing printing time or reducing spatial resolution in printed images. This is accomplished by varying the ink droplet volumes ejected from the ink delivery nozzles 45. Printer apparatus 10 neither increases the number of printing passes with a subset of pixels printed in each pass nor eliminates printed pixels as in the prior art.

The invention has been described in detail with particular reference to certain preferred embodiments thereof, but it is understood that variations and modifications can be effected within the spirit and scope of the invention. For example, the present invention is compatible with an ink-jet apparatus using inks of different densities for each color. As another example, the present invention can also incorporate printing modes such as depositing a plurality of ink droplets at each image location on a receiver medium in one or more passes. Therefore, what is provided is an ink jet printing apparatus and method accommodating printing mode control for printing variable density levels on a receiver medium in a manner solving the problems of ink beading and color bleeding while avoiding excessive printing time and excessive ink laydown.

The invention has been described in detail with particular reference to certain preferred embodiments thereof, but it will be understood that variations and modifications can be effected within the spirit and scope of the invention.

PARTS LIST

10 . . . ink jet printer apparatus
20 . . . electronic memory
30 . . . receiver medium
40 . . . image processor
45 . . . nozzle
46 . . . ink chamber
47 . . . ink droplet
50 . . . inkjet print head
60 . . . printer Performance Look-Up Table (PLUT)
70 . . . printer performance curve
80 . . . waveform
90 . . . group of square pulses
95 . . . first image calibrator
100 . . . second image calibrator
105 . . . Mode Look-Up Table (MLUT)
107 . . . input printer mode selector
110 . . . image halftoning unit
200 . . . controller
210 . . . waveform generator
220 . . . nozzle selector
230 . . . electromechanical transducer
240 . . . heat generating element

What is claimed is:

1. An ink jet printing apparatus capable of receiving an input image having a plurality of pixels comprising:

(a) a printhead;

(b) at least one nozzle integrally attached to said printhead, said nozzle capable of ejecting an ink droplet;

(c) a waveform generator connected to said printhead for generating an electronic waveform to be supplied to said nozzle for ejecting the ink droplet, the waveform defined by a plurality of pulses;

(d) a printer preformance look-up table associated with said waveform generator for storing at least one electronic waveform serial number assigned to the corresponding waveform; and (e) a calibrator associated with said printer performance look-up table and said waveform generator for selecting electronic waveform serial numbers according to a printer mode.

2. The apparatus of claim 1, wherein the printer mode is printing image resolution.

3. The apparatus of claim 1, wherein the printer mode is printhead speed.

4. The apparatus of claim 1, wherein the printer mode is receiver type.

5. The apparatus of claim 1, wherein the printer mode is stored in a printer-mode look-up table associated with said calibrator.

6. The apparatus of claim 1, further comprising an electromechanical transducer disposed in said nozzle and responsive to said waveform for ejecting the ink droplet from said nozzle.

7. The apparatus of claim 6, wherein said electromechanical transducer is formed of a piezoelectric material.

8. The apparatus of claim 1, further comprising a heat generating element disposed in said nozzle for generating thermal energy responsive to said waveform for ejecting the ink droplet from said nozzle.

9. An ink jet printing apparatus capable of receiving an input image having a plurality of pixels, each pixel being defined by at least one pixel value, comprising:

(a) a printhead;

(b) at least one nozzle integrally attached to said printhead, said nozzle capable of ejecting a plurality of ink droplets;

(c) a waveform generator connected to said printhead for generating a plurality of electronic waveforms to be supplied to said nozzle for ejecting the ink droplets, the waveforms defined by a plurality of pulses;

(d) a printer performance look-up table for storing a plurality of electronic waveform serial numbers assigned to respective waveforms described by at least one predetermined parameter;

(e) a first calibrator associated with said waveform generator for converting the pixel values of the input image to waveform index numbers associated with waveform serial numbers; and (f) a second calibrator associated with said printer performance look-up table and said waveform generator for selecting electronic waveform serial numbers according to the printer mode.

10. The apparatus of claim 9, wherein the printer mode is printing image resolution.

11. The apparatus of claim 9, wherein the printer mode is printhead speed.

12. The apparatus of claim 9, wherein the printer mode is receiver type.

13. The apparatus of claim 9, wherein the printer mode is stored in a printer-mode look-up table associated with said second calibrator.

14. The apparatus of claim 9, further comprising an electromechanical transducer disposed in said nozzle and responsive to said waveform for ejecting the ink droplets from said nozzle.

15. The apparatus of claim 14, wherein said electromechanical transducer is formed of a piezoelectric material.

16. The apparatus of claim 9, further comprising a heat generating element disposed in said nozzle for generating thermal energy responsive to said waveforms for ejecting the ink droplets from said nozzle.

17. The apparatus of claim 9, further comprising an image halftoning unit connected to said second calibrator for halftoning the calibrated image to generate a halftoned image having pixel values defined by the waveform serial numbers.

18. The apparatus of claim 9, further comprising a controller associated with said second calibrator and interconnecting said printer performance look-up table and said waveform generator for generating waveform parameters to be received by said waveform generator according to the waveform serial numbers provided by said second calibrator.

19. The apparatus of claim 9, further comprising a nozzle selector interconnecting said waveform generator and said print head for selecting said nozzle for actuation.

20. An ink jet printing method capable of processing an input image having a plurality of pixels, comprising the steps of:

(a) providing a printhead;

(b) providing at least one nozzle integrally attached to the printhead, the nozzle capable of ejecting an ink droplet;

(c) providing a waveform generator connected to the printhead for generating an electronic waveform to be supplied to the nozzle for ejecting the ink droplet, the waveform defined by a plurality of pulses;

(d) providing a printer preformance look-up table associated with the waveform generator for storing at least one electronic waveform serial number assigned to a corresponding waveform; and (e) providing a calibrator associated with the printer performance look-up table and the waveform generator for selecting electronic waveform serial numbers according to a printer mode.

21. The apparatus of claim 20, wherein the step of providing a calibrator comprises the step of providing a calibrator wherein the printer mode is printing image resolution.

22. The apparatus of claim 20, wherein the step of providing a calibrator comprises the step of providing a calibrator wherein the printer mode is printhead speed.

23. The apparatus of claim 20, wherein the step of providing a calibrator comprises the step of providing a calibrator wherein the printer mode is receiver type.

24. The apparatus of claim 20, wherein the step of providing a calibrator comprises the step of providing a calibrator wherein the printer mode is stored in a printer-mode look-up table associated with the calibrator.

25. The apparatus of claim 20, further comprising the step of providing an electromechanical transducer disposed in the nozzle and responsive to the waveform for ejecting the ink droplet from the nozzle.

26. The apparatus of claim 20, wherein the step of providing an electriomechanical transducer comprises the step of providing an electromechanical transducer formed of a piezoelectric material.

27. The apparatus of claim 20, further comprising the step of providing a heat generating element disposed in the nozzle for generating thermal energy responsive to the waveform for ejecting the ink droplet from the nozzle.

28. An ink jet printing method capable of processing an input image having a plurality of pixels, each pixel being defined by at least one pixel value, comprising the steps of:

(a) providing a printhead;

(b) providing at least one nozzle integrally attached to the printhead, the nozzle capable of ejecting a plurality of ink droplets;

(c) providing a waveform generator connected to the printhead for generating a plurality of electronic waveforms to be supplied to the nozzle for ejecting the ink droplets, the waveforms being defined by a plurality of pulses;

(d) providing a printer performance look-up table for storing a plurality of electronic waveform serial numbers assigned to respective waveforms described by at least one predetermined parameter;

(e) providing a first calibrator associated with the waveform generator for converting the pixel values of the input image to waveform index numbers associated with the waveform serial numbers; and (f) providing a second calibrator associated with the printer performance look-up table and the waveform generator for selecting electronic waveform serial numbers according to the printer mode.

29. The apparatus of claim 28, wherein the step of providing a calibrator comprises the step of providing a calibrator wherein the printer mode is printing image resolution.

30. The apparatus of claim 28, wherein the step of providing a calibrator comprises the step of providing a calibrator wherein the printer mode is printhead speed.

31. The apparatus of claim 28, wherein the step of providing a calibrator comprises the step of providing a calibrator wherein the printer mode is the receiver type.

32. The apparatus of claim 28, wherein the step of providing a calibrator comprises the step of providing a calibrator wherein the printer mode is stored in a printer-mode look-up table associated with the second calibrator.

33. The apparatus of claim 28, further comprising the step of providing an electromechanical transducer disposed in the nozzle and responsive to the waveform for ejecting the ink droplets from the nozzle.

34. The apparatus of claim 33, wherein the step of providing an electromechanical transducer comprises the step of providing an electromechanical transducer formed of a piezoelectric material.

35. The apparatus of claim 28, further comprising the step of providing a heat generating element disposed in the nozzle for generating thermal energy responsive to the waveforms for ejecting the ink droplets from the nozzle.

36. The apparatus of claim 28, further comprising the step of providing an image halftoning unit connected to the second calibrator for halftoning the calibrated image to generate a halftoned image having pixel values defined by the waveform serial numbers.

37. The apparatus of claim 28, further comprising the step of providing a controller associated with the second calibrator and connecting the printer performance look-up table and the waveform generator for generating waveform parameters to be received by the waveform generator according to the waveform serial numbers provided by the second calibrator.

38. The apparatus of claim 28, further comprising the step of providing a nozzle selector interconnecting the waveform generator and the print head for selecting the nozzle for actuation.

* * * * *